US008864333B2

(12) United States Patent
Burkart et al.

(10) Patent No.: US 8,864,333 B2
(45) Date of Patent: Oct. 21, 2014

(54) GOLF LIGHTING SYSTEM

(71) Applicant: The Toro Company, Bloomington, MN (US)

(72) Inventors: Philip A. Burkart, Murrieta, CA (US); Dale A. Anderson, Riverside, CA (US); Randall Pearson, Chino Hills, CA (US); Miguel A. Santiago, Claremont, CA (US)

(73) Assignee: The Toro Company, Bloomington, MA (US)

( * ) Notice: Subject to any disclaimer, the term of this patent is extended or adjusted under 35 U.S.C. 154(b) by 35 days.

(21) Appl. No.: 13/801,935

(22) Filed: Mar. 13, 2013

(65) Prior Publication Data

US 2014/0185278 A1 Jul. 3, 2014

Related U.S. Application Data

(60) Provisional application No. 61/747,177, filed on Dec. 28, 2012.

(51) Int. Cl.
*F21V 33/00* (2006.01)
*A63B 57/00* (2006.01)

(52) U.S. Cl.
CPC ..... *F21V 33/008* (2013.01); *A63B 57/0056* (2013.01)
USPC ..... 362/234; 362/249.02; 362/253; 362/294; 362/311.02; 473/176

(58) Field of Classification Search
USPC ..... 362/234, 249.02, 253, 294, 311.02; 373/173–176
See application file for complete search history.

(56) References Cited

U.S. PATENT DOCUMENTS

| | | | | |
|---|---|---|---|---|
| 5,445,373 | A * | 8/1995 | Franks | 473/150 |
| 5,685,780 | A | 11/1997 | Desjardins | |
| 6,699,137 | B2 | 3/2004 | Szymanski | |
| 7,594,859 | B2 | 9/2009 | Mullen | |
| 2010/0004068 | A1 | 1/2010 | Adame | |
| 2010/0160057 | A1 | 6/2010 | Willett | |

FOREIGN PATENT DOCUMENTS

WO WO 2012/032037 A1 3/2012

* cited by examiner

*Primary Examiner* — Stephen F Husar
(74) *Attorney, Agent, or Firm* — Inskeep IP Group, Inc.

(57) ABSTRACT

A golf lighting system includes a golf cup light assembly having a cup housing sized to fit within a golf cup hole and a light source disposed within the housing and configured to illuminate a cup-shaped portion of the housing. The system also includes a plurality of partially removable lighting devices, each of which having a base portion fixed within the ground and a removable, riser-mounted light.

20 Claims, 13 Drawing Sheets

GOLF LIGHTING SYSTEM

RELATED APPLICATIONS

This application claims priority to U.S. Provisional Application Ser. No. 61/747,177 filed Dec. 28, 2012 entitled Golf Cup Light, which is hereby incorporated herein by reference in its entirety.

BACKGROUND OF THE INVENTION

Golf is a precision club and ball sport in which competing players (or golfers) use many types of clubs to hit balls into a series of holes (i.e., cups) on a golf course using the fewest number of strokes. As such, golf typically demands good visibility of the course and especially the holes into which the players must hit their golf balls. Early mornings, evenings, inclement weather (e.g., fog, heavy clouds, rain), and other low lighting conditions can reduce the visibility of golf holes and effectively limit a golfer's ability to play the game.

SUMMARY OF THE INVENTION

One embodiment of the present invention is directed to an illuminated golf cup insert assembly. Specifically, the golf cup insert device includes a top golf cup having a lower surface with a plurality of openings. A light assembly is fixed to the underside of the top cup and includes a plurality of light-emitting elements oriented to shine through the bottom of the cup. Preferably, the light-emitting elements are powered by a battery that can be recharged via a power connector on the underside of the illuminated golf cup assembly. The cup assembly is preferably configured such that when it is connected to a battery-recharging power assembly, the circuit powering the lights is interrupted, thereby automatically turning the lights off.

In another embodiment, the cup assembly includes a wireless charging mechanism to allow the rechargeable battery to be charged without the need for a wired connector. For example, this mechanism may use inductive power transfer to achieve this recharging capability.

The cup assembly can also include an accelerometer configured to modify the lights when a ball enters the cup portion and strikes the bottom surface of the cup. For example, the lights may be turned on, off, dimmed, brightened, or their color may be changed. The cup assembly may also include an optical sensor (e.g., a photocell) configured to turn the lights off when the ambient light around the cup exceeds a predetermined threshold. The optical sensor may also be used to help differentiate between a golf ball entering the cup and the insertion of a flag when triggered by the accelerometer or even without the use of the accelerometer.

In one embodiment, the cup assembly may also include a wireless communications module that allows wireless communications with other devices on the network. For example, other device can turn on or off the cup assembly, or these devices can receive a light status message (e.g., indicating if the lights are on or off) or a battery status message (e.g., indicating a battery percentage level or a low battery warning).

In another embodiment, the flag may include an array of photovoltaic cells near or along its top portion and a conductor assembly on its base for creating an electrical connection to the cup assembly and transferring power to the rechargeable battery. In this manner, the flag can help recharge the batteries.

In another embodiment, the flag includes one or more optical fibers for conveying light from the cup assembly to the top region of the flag. For example, the optical fibers may terminate at the bottom of the flag and interface with one or more of the cup assembly's lights. The top of the optical fiber may be located near the top of the flag and may terminate with an optical lens or light diffusing member which allows a portion of the flag to be illuminated and better seen by golf players. This also allows holes and flags to be color-coded to correspond to a hole number (i.e., each hole has its own illuminated color to help players find the flags/holes and differentiate each hole).

Another embodiment of the present invention includes a plurality of light devices that each comprise a base portion that is fixed in the ground and a removable riser portion. The riser portion includes an elongated riser having a light-generating portion at its first end. A second end of the riser fits within a cavity of the base, which is preferably buried such that its top surface is level with the soil or turf. The base is wired to an electrical source and includes electrical connectors within its cavity that can align with a second set of electrical connectors on the riser's second end. Hence, when the second end of the riser is inserted into the cavity of the base portion, the light-generating portion is supplied with power, thereby turning on. The base portions can preferably be located around a green of a golf course hole, allowing users to add the riser portion as desired or necessary based on ambient lighting conditions.

BRIEF DESCRIPTION OF THE DRAWINGS

These and other aspects, features and advantages of which embodiments of the invention are capable of will be apparent and elucidated from the following description of embodiments of the present invention, reference being made to the accompanying drawings, in which.

DESCRIPTION OF EMBODIMENTS

Figure 1:
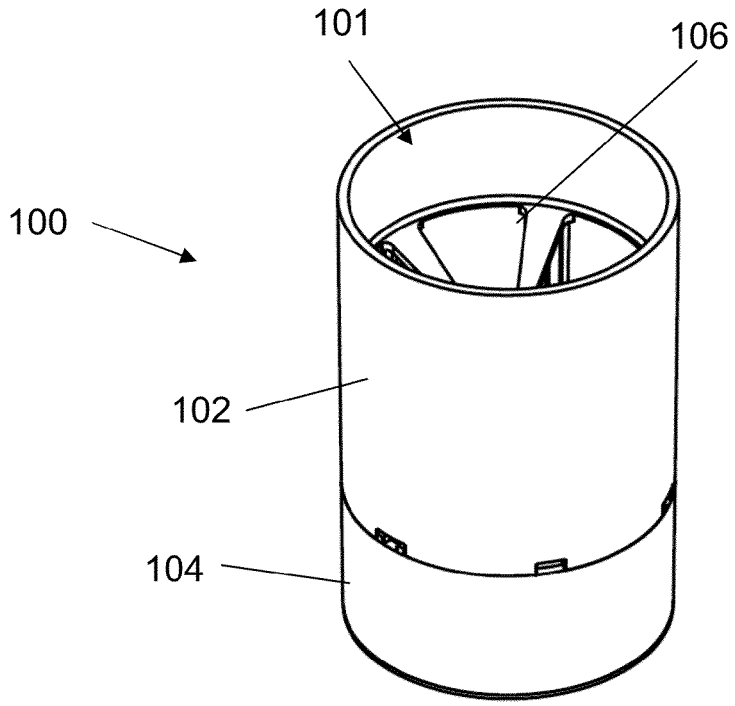
FIG. 1 is a top perspective view of the golf cup assembly according to the present invention.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

FIG. 1 illustrates an embodiment of an illuminated golf cup device 100 having a golf ball cup portion 101 with a lower surface 106 through which light shines to illuminate the cup portion 101 and optionally a pin or flag fixed within the cup portion 101. When illuminated, the cup device 100 increases visibility of the cup portion 101 and the pin to nearby golf players, especially in low-light conditions.

Figure 6:
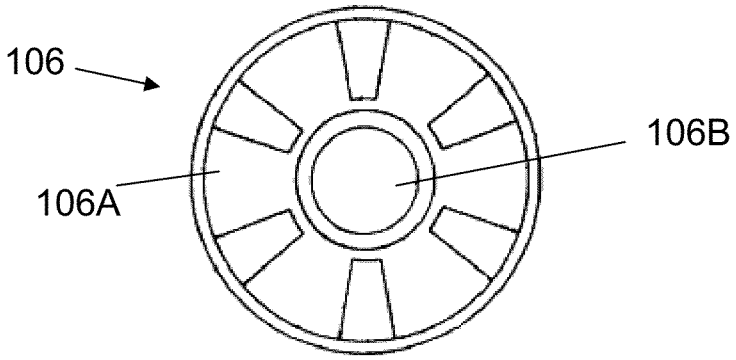
FIG. 6 is a top view of the golf cup assembly of FIG. 1.

The golf ball cup portion 101 comprises a cylinder member 102 having an inner cup bottom 106, best seen in FIG. 6. Preferably, the cylinder member 102 has a diameter of about 4.25 inches and the bottom 106 has a depth of about 4 inches and is otherwise shaped to be a "drop-in" replacement for existing, non-illuminated golf cups.

In one example, the cup bottom 106 includes a center pin aperture 106B for mounting a pin or flag, and a plurality of elongated openings 106A extending around the aperture 1068. Preferably, the surface of the cup bottom is downwardly angled towards a lowest point, in the center of the bottom 106. The openings 106A can be apertures or can be filled with clear material, such as a clear polymer. Preferably, the openings 106A are configured such that they act as "keying" features within the cup portion 101 for practice green flags with a large base.

Figure 2:
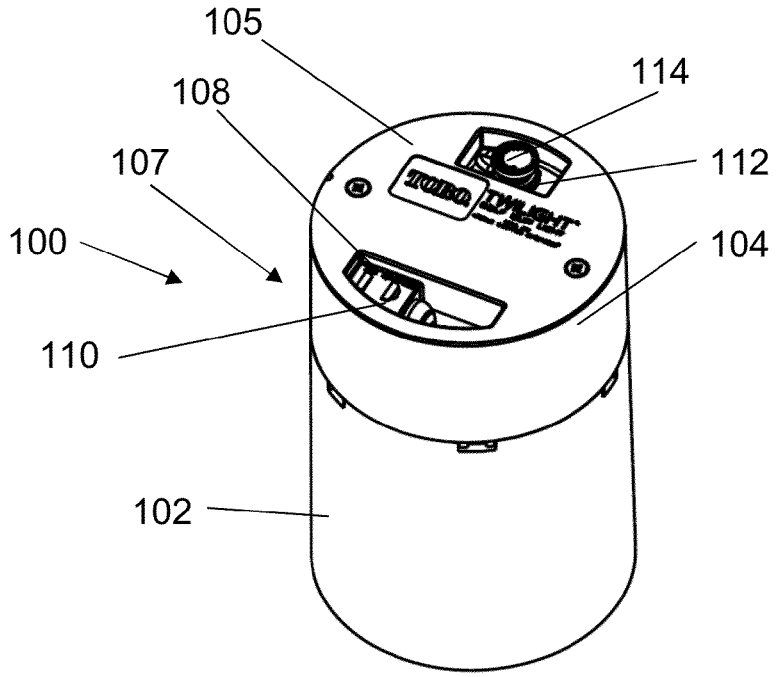
FIG. 2 is a bottom perspective view of the golf cup assembly of FIG. 1.
Figure 3:
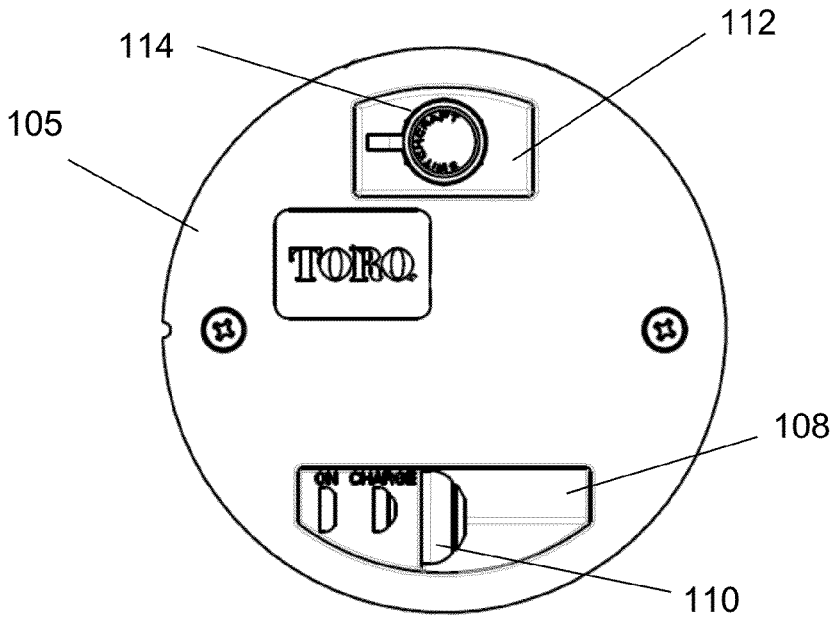
FIG. 3 is a bottom view of the golf cup assembly of FIG. 1.

FIGS. 2 and 3 illustrate various views of the lower assembly 107 which contains the electrical components of the device 100 in a sealed compartment. The assembly 107 includes a cylinder member 104 that is connected to a bottom member 105, forming a compartment.

The bottom member 105 includes a first depression 108 in which a push-button on/off switch 110 is located, and a second depression 112 in which a battery charge port 118 and charge port cover 114 are located. In this respect, the device 100 can be easily removed and turned off and/or connected to a power supply for charging.

Figure 4:
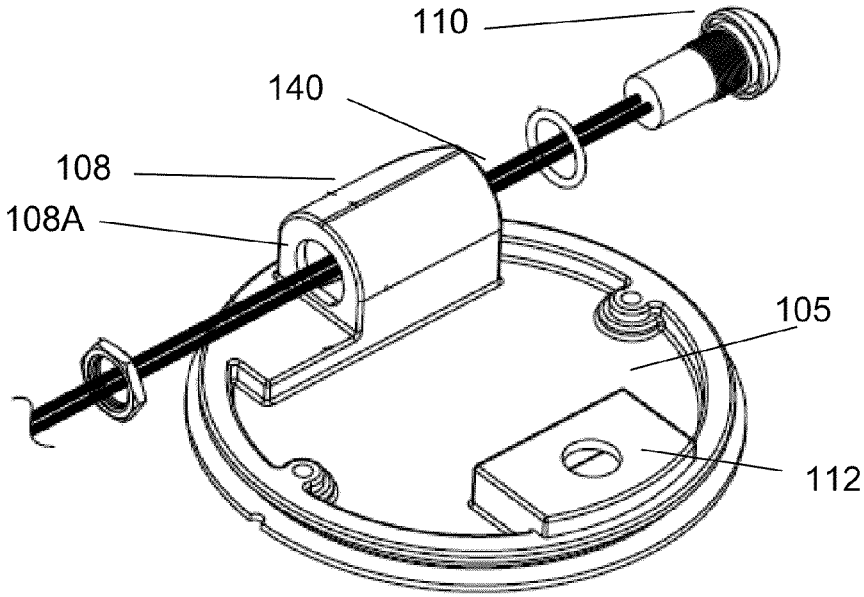
FIG. 4 is a perspective view of the bottom plate of the golf cup assembly of FIG. 1.
Figure 5:
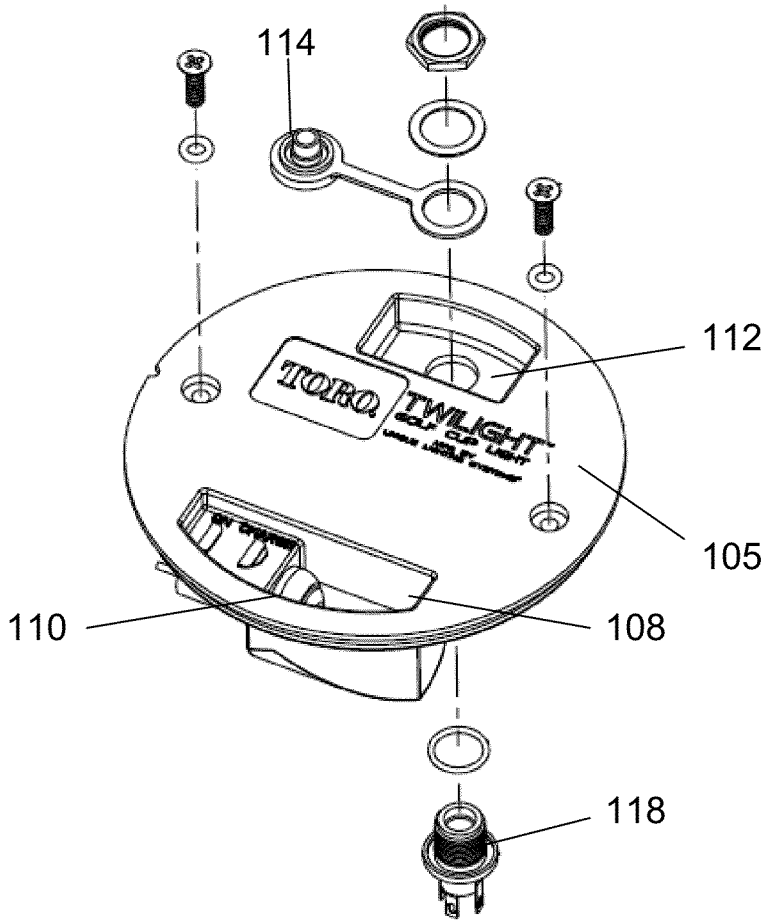
FIG. 5 is an exploded view of the bottom plate of the golf cup assembly of FIG. 4.

FIG. 4 illustrates the inner side of bottom member 105, including the switch 110 which is mounted through aperture 108A. FIG. 5 illustrates an exploded view of the bottom member 105 with the charge port 118 and the charge port cover 114. Preferably the charge port cover 114 comprises a flexible material, such as rubber or silicone for preventing the ingress of water to the charge port electrodes.

Figure 7:
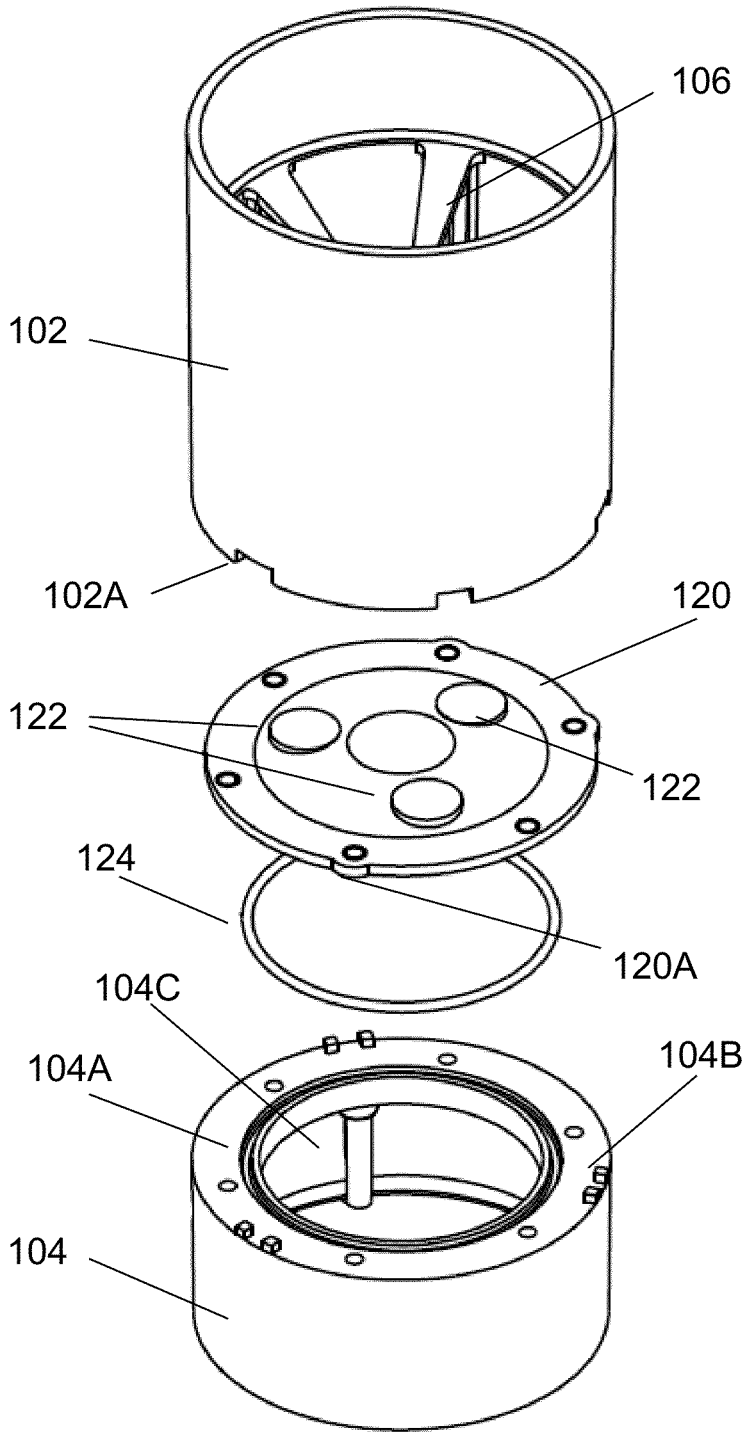
FIG. 7 is an exploded view of a top portion of the golf cup assembly of FIG. 1.
Figure 8:
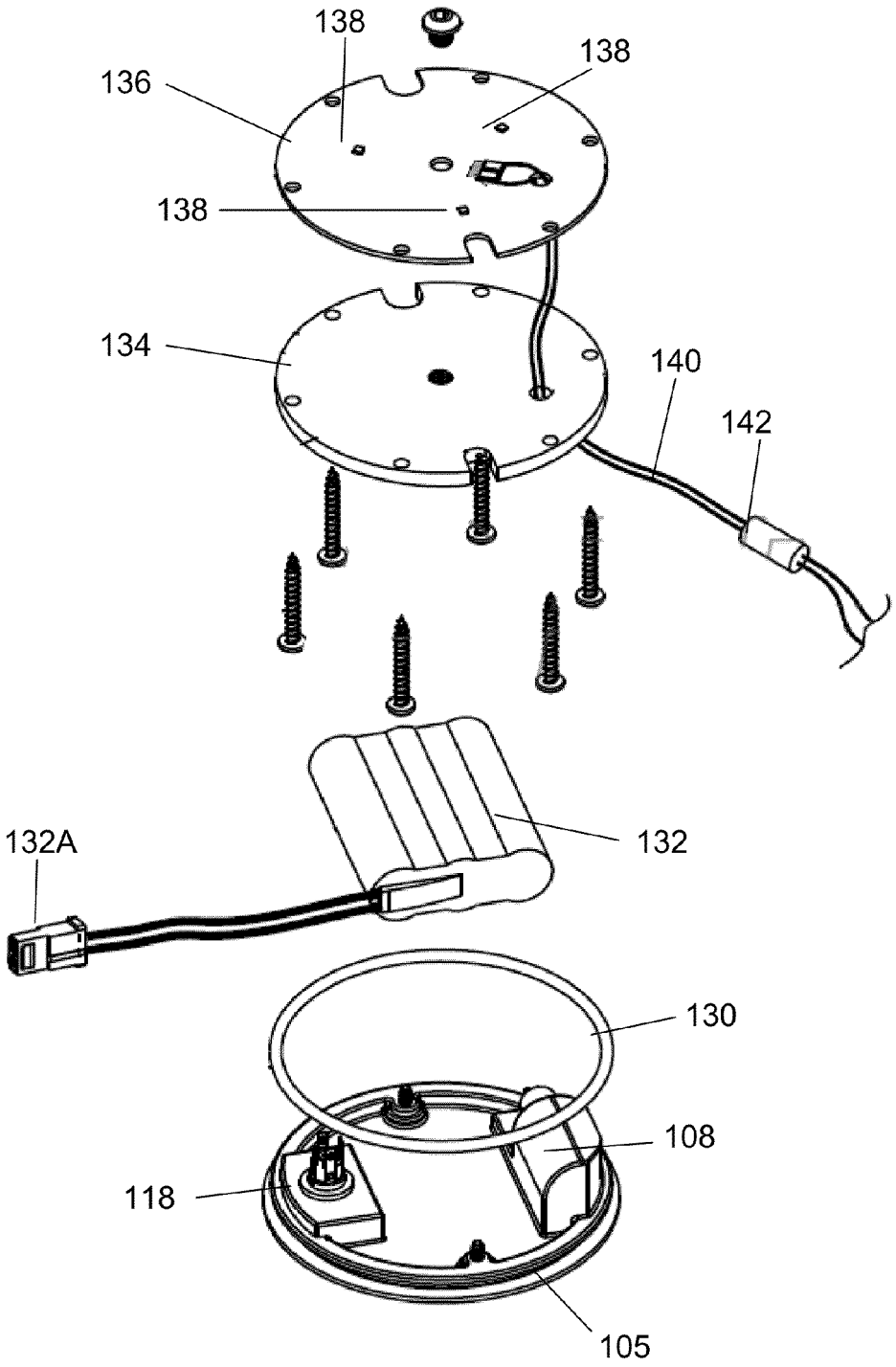
FIG. 8 is an exploded view of a bottom portion of the golf cup assembly of FIG. 1.
Figure 9:
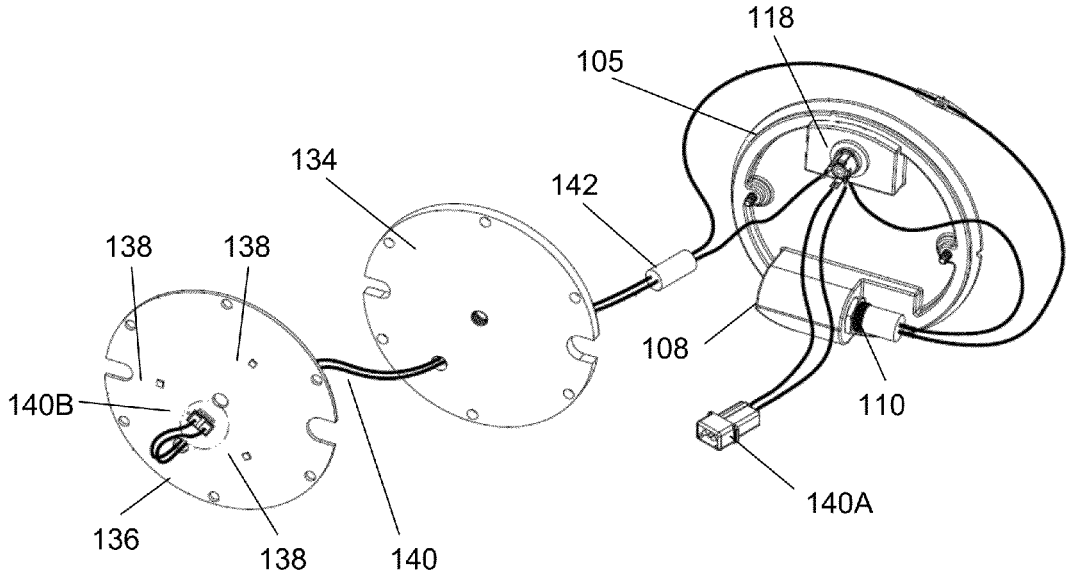
FIG. 9 is an exploded view of a bottom portion of the golf cup assembly of FIG. 1.

Referring to FIGS. 7, 8, and 9, a lens plate 120 is fixed to the top of cylinder member 104 and includes a plurality of lenses 122 through which light shines into the cup portion 101. In one example, the lens plate 120 includes three discrete lenses 122, though 1, 2, 4, 5, 6, or any number of discrete lenses 122 can be used, depending on the number of light sources and configuration of the openings of the cup portion 101.

Preferably, the lenses 122 align with the openings 106A of the cup bottom 106 to allow light to shine into the cup portion 101. To maintain this alignment of the lenses 122, the cylinder member 104, lens plate 120, and cylinder member 102 all have interlocking alignment features that fix the rotational orientation of these elements relative to each other. For example, the cylinder member 102 includes a plurality of grooves 102A in its underside, the lens plate 120 includes a plurality of radial tabs 120A, and the cylinder member 104 includes a plurality of raised projections 104B. The raised projections 104B are located in pairs and spaced apart such that each of the tabs 120A can fit between the pairs without a substantial amount of movement. The grooves 102A are deep enough to accommodate the tabs 120A and projections 104B, therefore the rotational position of these elements are locked relative to each other without otherwise creating a gap between the other interfacing surfaces of cylinder members 102 and 104.

To help seal the cavity of the lower assembly 107 from water and dirt, an upper o-ring 124 is located between the lens plate 120 and the cylinder member 104. The location of the o-ring 124 is further retained by a circular groove 104A along the top surface of the cylinder member 104. Similarly, a lower o-ring 130 is located between bottom member 105 and the lower surface of the cylinder member 104.

The cavity formed within the lower assembly 107 contains, among other things, a printed circuit board 136, a heat sink 134, battery 132, a constant current driver 142, and wire 140. The printed circuit board 136 preferably includes the light emitting sources 138 (e.g., light emitting diodes or LEDs) which are aligned beneath each of the lenses 122, as well as any related circuitry necessary for operation of the light emitting sources 138. As described later in this specification, various sensors may also be included on the board 136. The wires 140 or circuit board 136 may include a driver 142 for maintaining a constant current through the wires, which is often necessary for proper operation of LEDs.

The heat sink 134 is located against an underside of the printed circuit board 136 and optionally coupled with a heat conductive substance, such as thermal paste. Since light sources like LEDs typically emit heat, the heat sink 134 helps draw any unwanted heat away from the light emitting sources 138 and the printed circuit board 136. Optionally, the heat sink 134 includes one or more apertures through which wires, such as wires 140 may pass through.

Both the circuit board 136 and heat sink 134 include a feature to maintain their rotational orientation at a predetermined position relative to other components of the lower assembly 107. For example, the circuit board 136 and heat sink 134 can each have two notches that engage and interlock with two corresponding key features 104 on the inner sides of cylinder member 104.

The device 100 is preferably powered by a rechargeable battery 132 that is located within the lower assembly 107. The battery 132 includes an electrical plug 132A that connects to a mating plug 140A, shown in FIG. 9.

Figure 10:
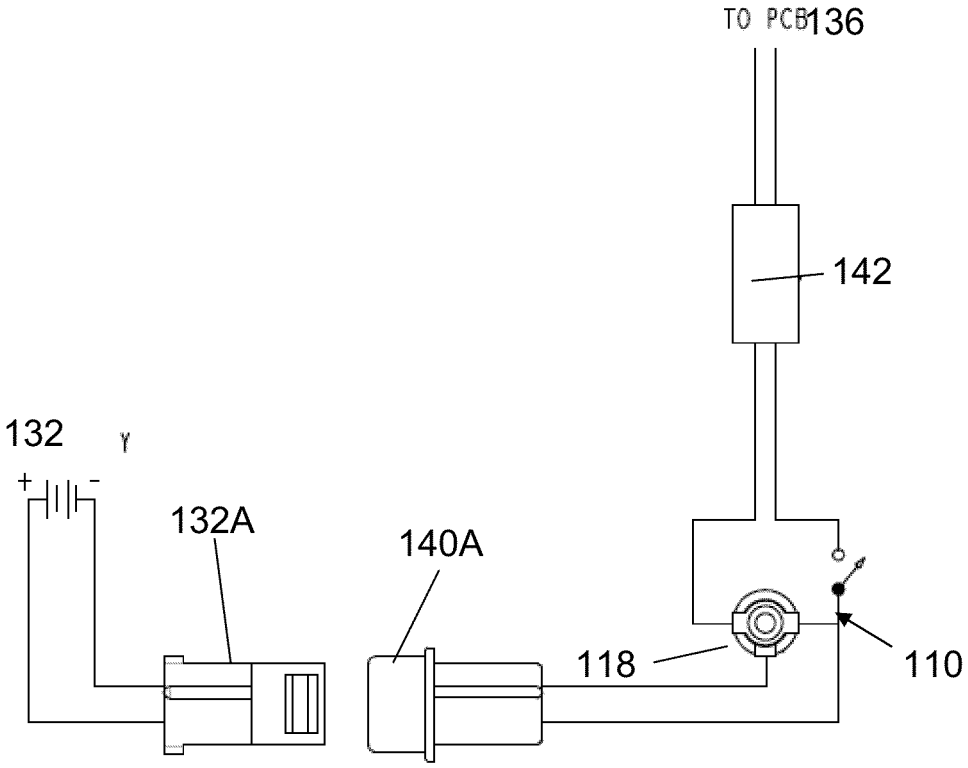
FIG. 10 is a schematic view of the electrical system of the golf cup assembly of FIG. 1.

In one embodiment, the electrical wiring is such that the device turns off when plugged into an external power source for recharging. For example, FIG. 10 illustrates an electrical schematic for the device 100. The battery charging port 118 is connected between the driver 142 and the plug 140A and therefore, when connected to an external power source, the port 118 interrupts the circuit between the plug 140A and the driver 142.

In one embodiment, the device 100 includes one or more sensors for modifying or controlling the behavior of the device. These sensors can be included on the circuit board 136 or in other areas of the device. For example, the device 100 may include an accelerometer and accompanying logic circuits (e.g., a microcontroller) that senses for a predetermined acceleration reading associated with a golf ball entering the cup portion 101 and modifies the light emitting sources 138. For example, the accelerometer may cause the light emitting sources 138 to blink, dim, brighten, turn on, turn off, change color, or any combination of these examples. In this respect, when a golf ball enters the cup portion 101, the user can be visually alerted.

In another example, the device 100 may include a light sensor (e.g., a photocell) and related circuitry for turning off the light emitting sources 138 when the ambient light outside the device 100 exceeds a predetermined level. Hence, the device 100 may turn on and off as needed based on the surrounding light level. The light sensor (or optionally a second light sensor) may also be used to help differentiate between a golf ball entering the cup portion 101 and insertion of a flag pole. For example, the light sensor can be located in or near the center aperture 106B and therefore can determine when the light level of the aperture 106B is such that it is covered by an inserted flag pole (e.g., completely dark). This sensor can be used alone or can be triggered with the previously described accelerometer.

In another example, the device 100 may include a wireless communication module (e.g., transmitter, receiver, and antenna) and accompanying logic circuits (e.g., a microcontroller) for controlling the light (e.g., turning the light on/off, changing color, brightening/dimming, blinking, etc.) or sending out messages to other devices (i.e., a battery status message indicating a percentage of battery remaining, a low battery warning, or a light status message indicating if the lights are on/off). In this respect, software on a central computer or remote control could be used to control, program, schedule or receive alerts from one more devices 100 wirelessly.

In another embodiment, the previously described wireless communication module can be used with a wireless, networking system, such as those seen in U.S. Pat. No. 7,719,432 and U.S. Pub. Nos. 2012/0068688 and 2004/0100394. For example, the device 100 can be used as part of a mesh communication network over a golf course, sending and receiving control data (e.g., commands to turn on/off or sending a light status or low battery signal) from other devices, such as a computer or remote control. In another example, the device 100 can also be a wireless repeater in a mesh network, relaying wireless commands from other devices according to a mesh communications protocol.

In another example, the communication module could be wired, using a two-wire encoder/decoder system known in the irrigation art for controlling operation of sprinklers over a two-wire power line. Since this arrangement provides power and communication data, a battery and battery-recharging port are not necessary.

Figure 11:
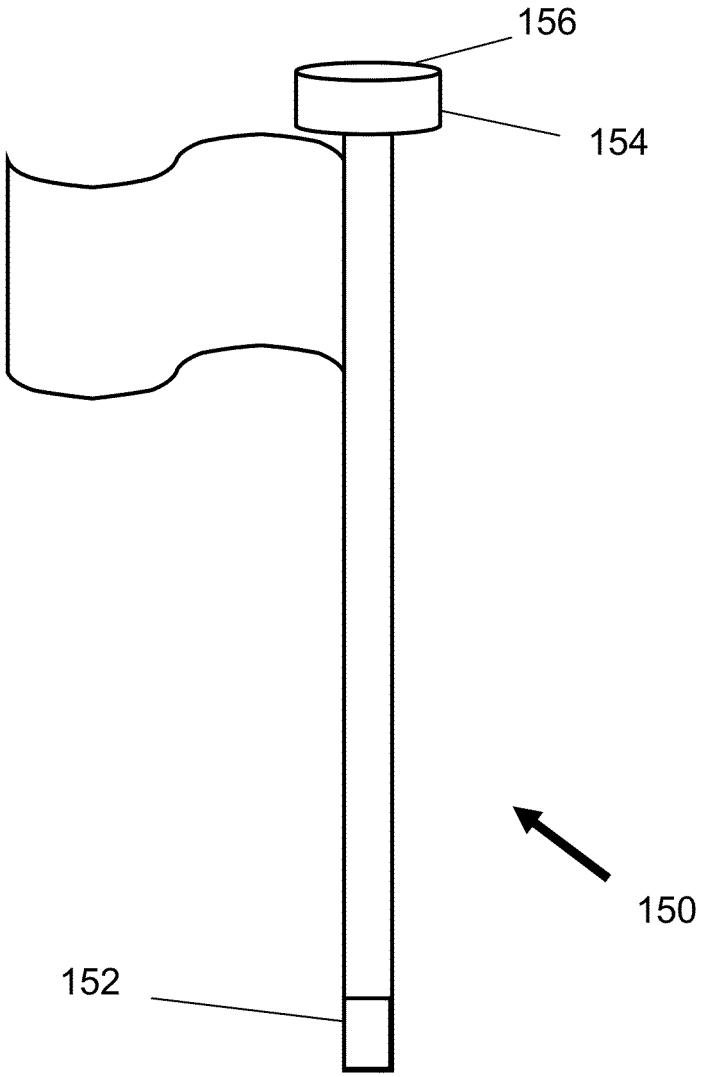
FIG. 11 is a side view of a golf flag according to the present invention.

FIG. 11 illustrates a flagpole 150 that can act as either a source for power, a source of additional light, or both, when connected to the device 100. First, the flag pole 150 can include a top surface 156 containing a plurality of solar or photovoltaic cells for generating electricity. Those cells can be connected to a connector 152 on the bottom of the pole via wires internal to the pole 150. The connector preferably includes at least two electrodes that interface with mating electrodes in the center aperture 106B of the cup portion 101, thereby allowing power to be transferred to the device and to recharge the battery 132. Preferably the sides 154 of the top portion of the flag pole 150 also emit light in a similar manner to the device 100. Optionally, the flag pole 150 can also be illuminated along the length of the pole itself (e.g., either the entire pole length or a portion of it).

In one example, the sides 154 can be illuminated via an optical fiber or fiber optic link that is located within the pole 150. The bottom of the optical fiber terminates at the connector 152 and interfaces at or near a light source within the device 100. The top end of the optical fiber terminates near the sides 154, which may include a plurality of transparent members, lenses, or light diffusing surfaces which allow the sides 154 to shine or glow.

In another example, the sides 154 may include one or more light emitting devices (e.g., an LED), which is coupled to connector 152 via electrical wires internal to the pole 150. The connector 152 may include additional electrical connectors for interfacing with the device 100 and drawing power to illuminate the light emitting devices. In this manner, the device 100 can illuminate the light sources at the top of the pole 150 in the same manner as its other light sources 138.

Figure 12:
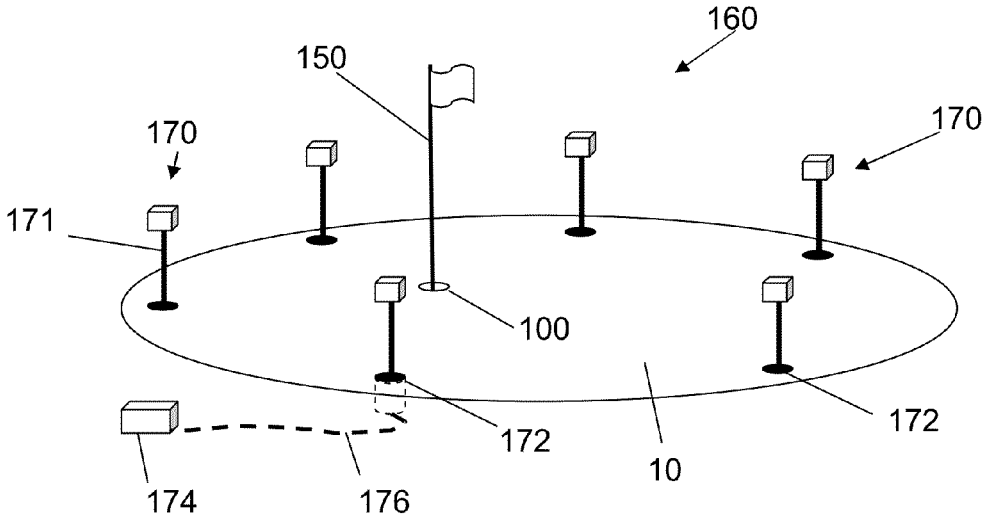
FIG. 12 is a perspective view of a golf green lighting system according to the present invention.
Figure 18:
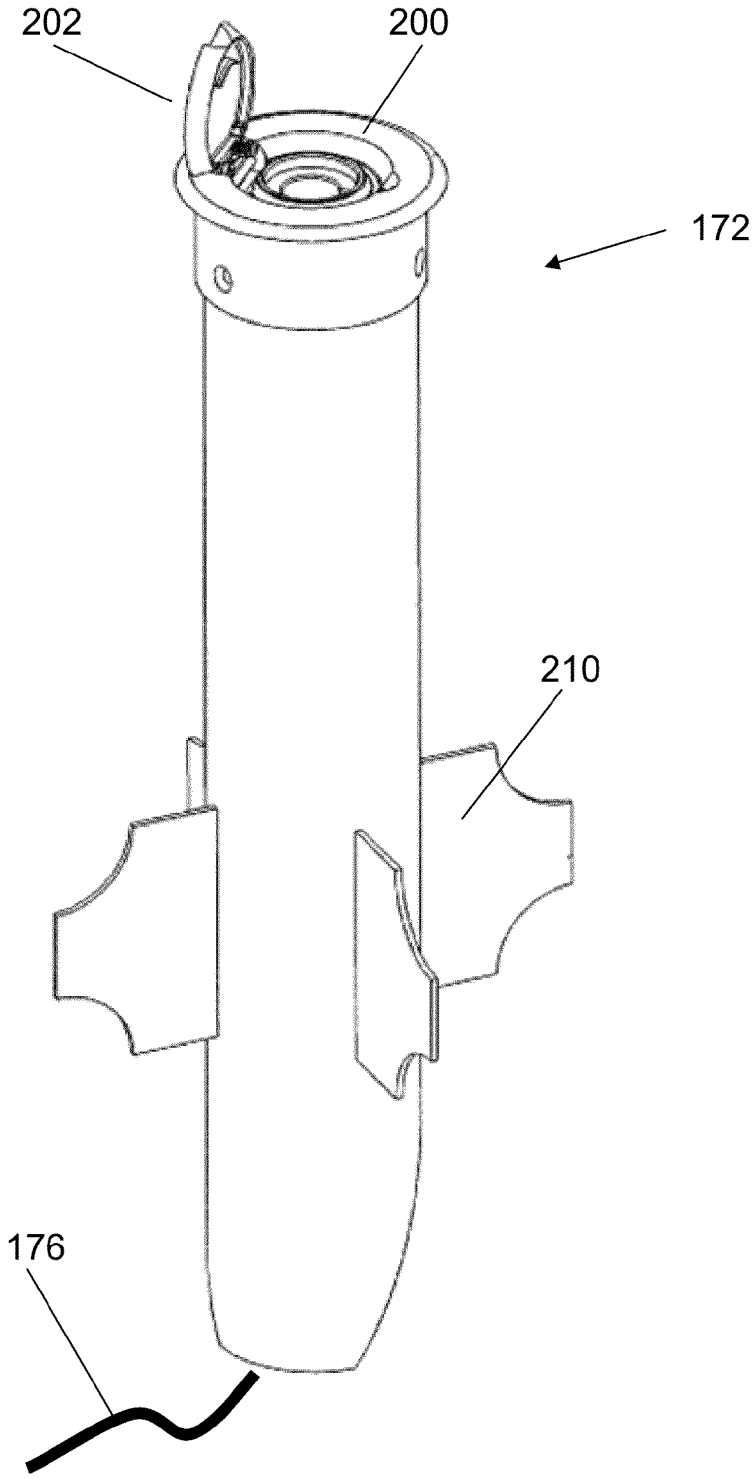

As seen in FIG. 12, the illuminated golf cup light 100 may also be used with a partially removable lighting system 160 having a plurality of lighting devices 170 located on or near a golf green. The lighting devices 170 include a removable light portion 171, seen best in FIG. 13 and a non-removable base portion, seen best in FIG. 18, which allows a user to easily add or remove the light portion 171 as desired.

Figure 13:
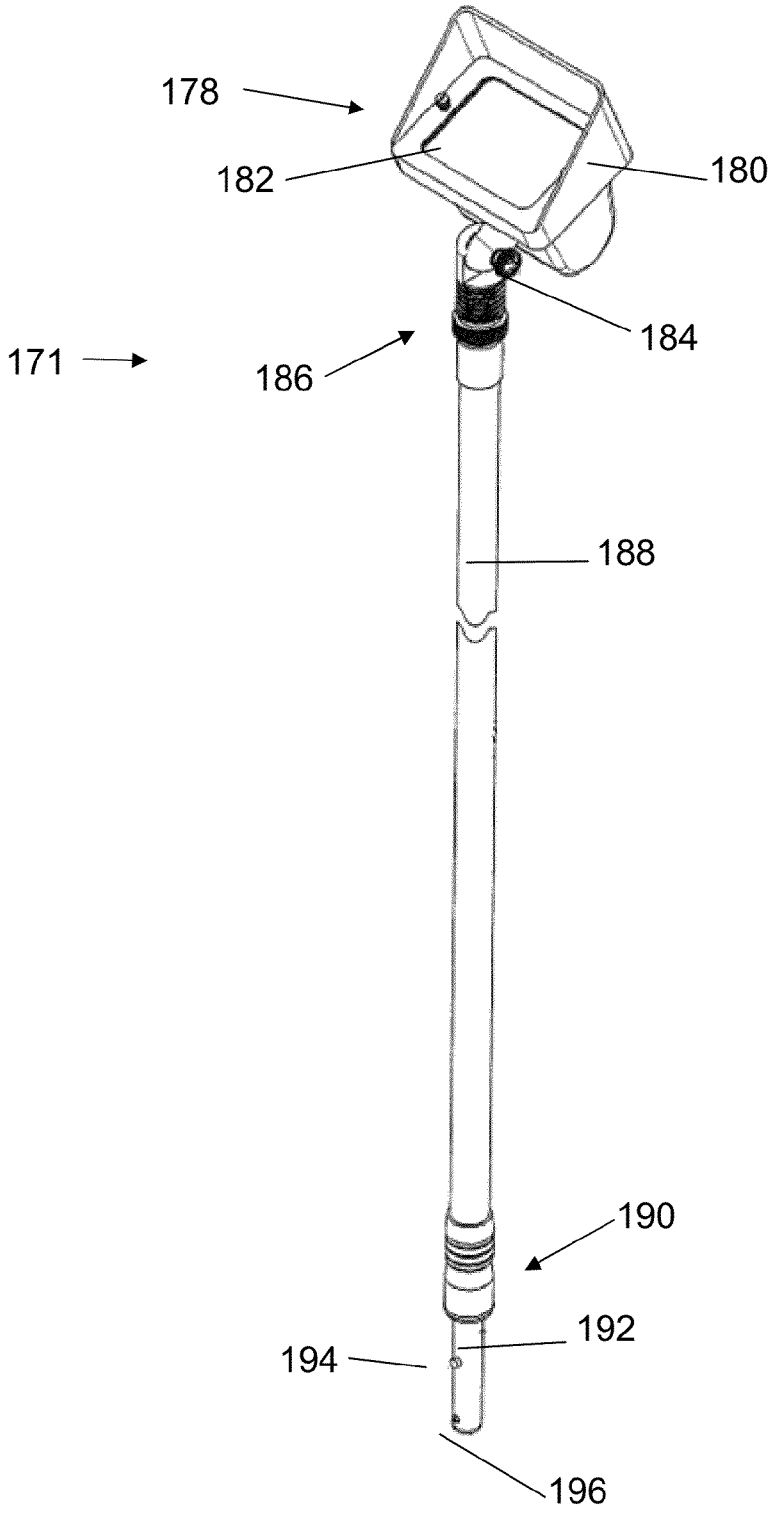
FIG. 13 is a side view of a removable light assembly according to the present invention.
Figure 14:
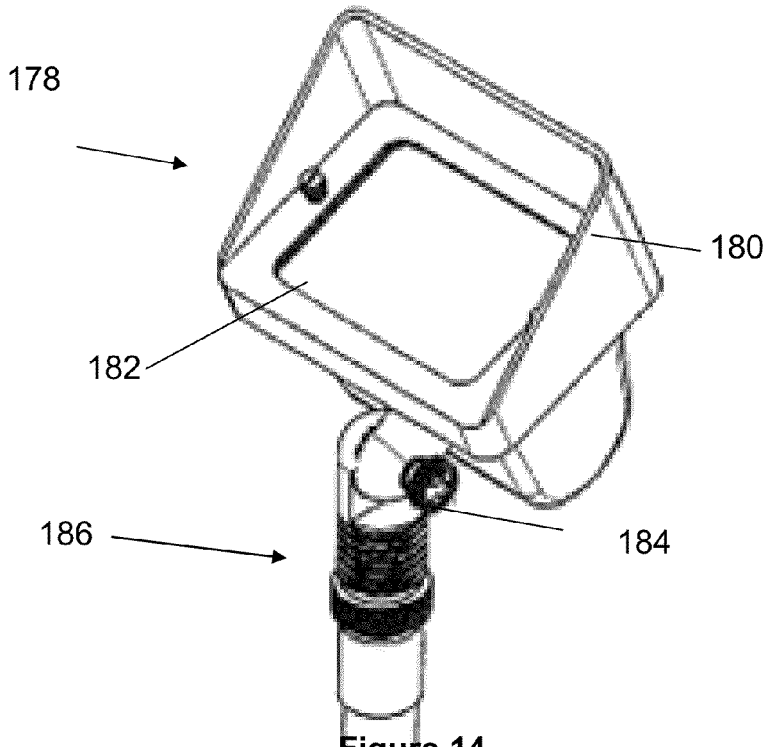
FIG. 14 is a side view of a light housing of the removable light assembly of FIG. 13, FIGS. 15 and 16 are various views of a stem portion of the removable light assembly of FIG. 13.

The light portion 171, seen in FIGS. 13 and 14, includes a light 178 comprising a housing 180 that contains a light bulb (e.g., such as an incandescent, halogen, or LED bulbs) that, when illuminated, shines through window 182. The light 178 is mounted to a top portion of a riser 188 (e.g., a hollow metal tube) and preferably includes one or more mechanisms for adjusting the orientation of the light 178. For example, the light 178 can be mounted to the riser 188 via a selectively-lockable hinge 184 for adjusting a vertical angle of the light 178 while a screw-clamp 186 allows the light's angle of rotation and height (e.g., via a telescoping arrangement) to be adjusted.

Figure 15:
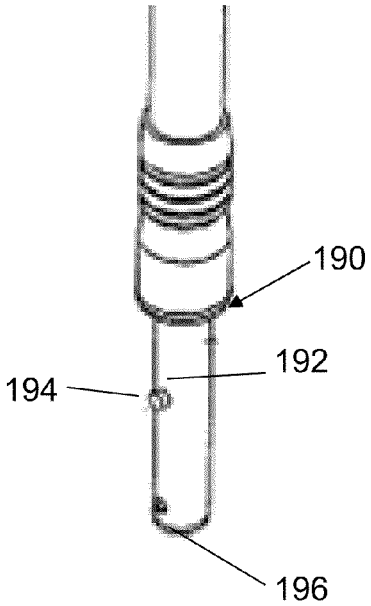
Figure 16:
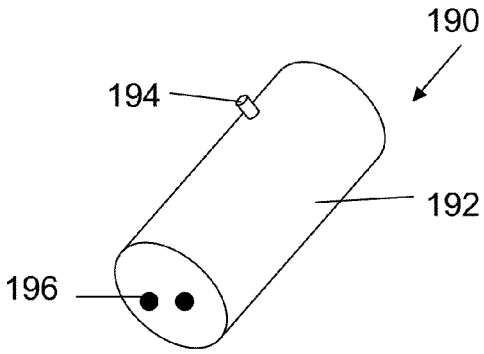

Preferably, the light bulb within the light 178 is connected to wires (not shown) that pass within the riser 188 to two female electrical connectors 196 on a bottom stem portion 190, seen in FIGS. 13, 15, and 16. When the stem portion 190 is inserted into the base 172, the electrical connectors 196 connect with two male connectors 208, which thereby supply power to the light bulb. Preferably, the connectors 208 supply a relatively low, direct current, such as 12 or 24 volts DC, which can be supplied via a transformer 174 connected by buried cable 176 (see FIG. 12). The transformer 174 can be "always on" to supply power to the light portion 171 whenever it is inserted into the base portion 172 or the transformer 174 can be connected to a timer, a manual switch, or a computer-controlled switch.

Figure 17:
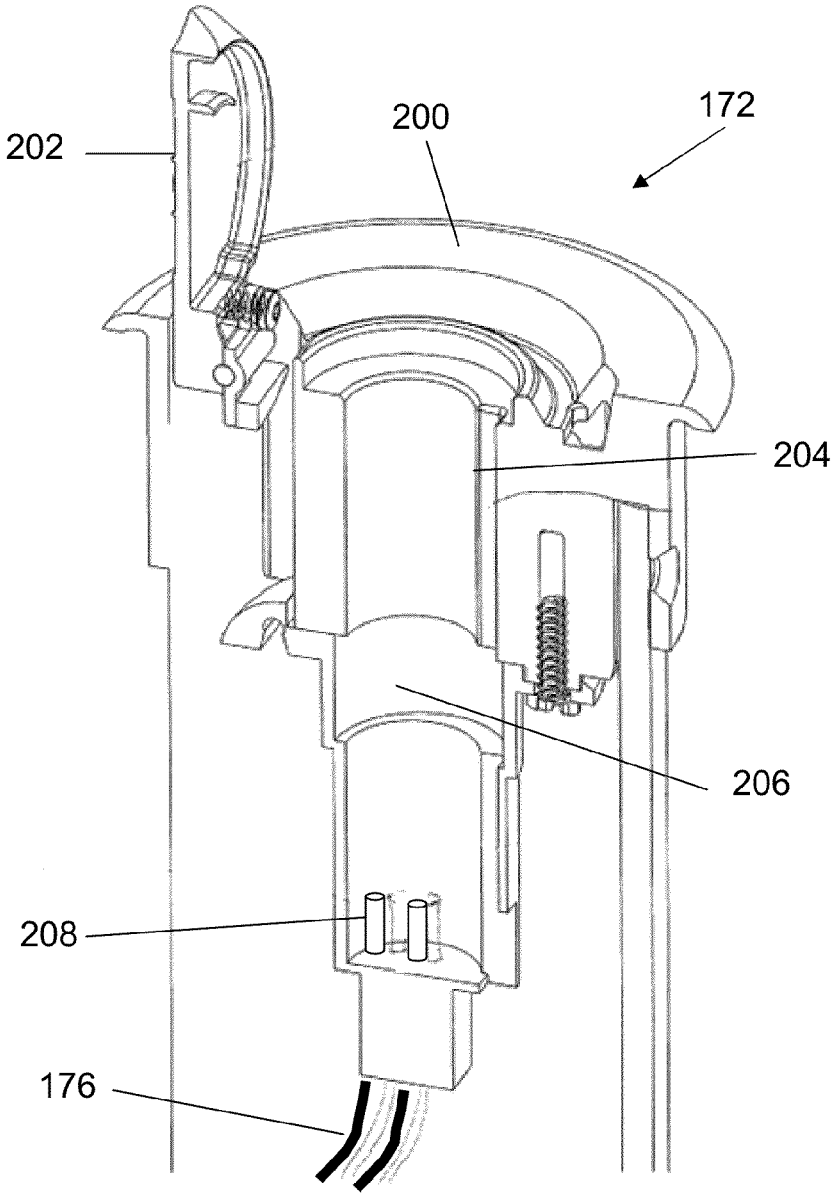
FIG. 17 is a cutaway view of a non-removable base portion according to the present invention, and, FIG. 18 is a perspective view of the base portion of FIG. 17.

As best seen in FIG. 17, the base portion 172 includes a housing 200 that forms a cylindrical aperture 206, sized to mate with the cylindrical portion 192 of the stem portion 190 (e.g., the cylindrical aperture 206 is slightly larger in diameter than the cylindrical portion 192). Preferably, the cylindrical aperture 206 includes a mechanism for forcing the stem portion 190 to be inserted in only one rotational orientation to prevent damage to connectors 208 and ensure that connectors 208 are aligned with connectors 196. For example, the cylindrical aperture 206 can include a vertical groove or keyway 204 having dimensions sized to accept the raised key 194 located on the side of the cylindrical portion 192 (i.e., the key 194 can slide down the keyway 204). The key 194 and the groove 204 are positioned in a rotational orientation such that, when aligned, connectors 196 and 208 are also aligned with each other. The keyway 204 preferably has a length sufficient that it does not hinder or stop the key 194 from downward movement.

The base portion 172 is buried in the ground such that the top of the housing 200 is substantially level with the ground. Preferably, the top of the housing 200 is located low enough that it will not be damaged by turf mowing devices. To prevent migration and/or lateral movement in the soil, the housing 200 includes a plurality of fins 210 to help anchor its position. Preferably, four fins 201 are each located at about 90 degrees from each other along the outside of the housing.

Finally, the base portion 172 includes a lid 202 that is attached to the housing 200 via a biased hinge. When closed, the lid 202 covers and seals the cylindrical aperture 206, preventing water and dirt from entering.

When natural light is reduced or otherwise low at the putting green of a golf hole, a user (e.g., groundskeeper, maintenance staff, or golfer) may bring an illuminated golf cup 100 and a plurality of lighting devices to the area. The golf cup 100 can be turning on and dropped into the golf cup hole. Additionally, the lid 202 of each base portion 172 can be opened and the stem portion 190 can be inserted into the cylindrical aperture 206 such that the key 194 and the keyway 204 align and the contacts 196 and 208 contact each other, allowing the light 178 to illuminate. Finally, the hinge 184 and clamp 186 can be adjusted to move the light 178 such that the window 182 points in a desired direction (e.g., towards the golf cup hole).

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A golf green lighting system, comprising:

a golf cup light assembly comprising a cup housing sized to fit within a golf cup hole and a light source disposed within said housing and configured to illuminate a cup-shaped portion of said housing; and, a plurality of partially removable lighting devices; each of said lighting devices comprising:

a base portion comprising an interior passage and a first set of electrical connectors; and, a light portion comprising a riser having a first end coupled to a light source and a second end having a second set of electrical connectors in electrical communication with said light source; wherein said second end of said riser selectively movable into and out of said interior passage of said base portion.

2. The lighting system of claim 1, wherein said golf cup light assembly further comprises a circuit board having a plurality of LEDs, a heat sink located beneath said circuit board and a plurality of lenses located over each of said plurality of LEDs.

3. The lighting system of claim 1, wherein said golf cup light assembly includes a driver maintaining a constant current from a battery to said light source.

4. The lighting system of claim 1, wherein said golf cup light assembly further comprises a battery charging port wired to turn off said light source when connected to an external power supply.

5. The lighting system of claim 1, wherein said golf cup light assembly further adjusts said light source based on sensor data from an accelerometer.

6. The lighting system of claim 1, wherein said golf cup light assembly further comprises a wireless communication module receiving commands for controlling said light source.

7. The lighting system of claim 1, wherein said second end of said light portion is shaped to enter said interior passage of said base portion at a predetermined rotational orientation.

8. The lighting system of claim 7, wherein said predetermined rotational orientation aligns said first set of electrical connectors with said second set of electrical connectors.

9. The lighting system of claim 1, wherein said light source comprises a plurality of LEDs.

10. The lighting system of claim 1, wherein said first set of electrical conductors of said base portion are coupled to a transformer.

11. The lighting system of claim 1, further comprising an adjustment mechanism disposed between said light source and said riser, said adjustment mechanism modifying an angle and rotational position of said light source relative to said riser.

12. A lighting system for a golf green, comprising:

a golf cup light assembly comprising:

a cup light assembly housing having a cylindrical shape and a diameter of about 4.25 inches;

a circuit board;

a plurality of LEDs connected to said circuit board;

a battery supplying power to said plurality of LEDs;

a plurality of lens members through which said plurality of LEDs illuminate a cup portion of said cup light assembly housing;

a plurality of partially removable lighting devices, comprising:

a base portion comprising a base housing forming an interior chamber and being mountable within soil; and, a light portion comprising an elongated member having a first end sized to fit within said interior chamber of said base and a second end coupled to a light source;

wherein said base portion supplies electrical power to said light source when said first end of said elongated member is located within said interior chamber of said base portion.

13. The lighting system of claim 12, wherein said base portion comprises a plurality of stabilizing fins on an outer surface of said base housing, stabilizing said base portion when buried in soil.

14. The lighting system of claim 12, wherein said first end of said elongated member includes a first set of electrical connectors and said interior chamber of said base portion includes a second set of electrical connectors that are connectable with said first set of electrical connectors.

15. The lighting system of claim 12, wherein a vertical angle and rotational position of said light source of said light portion is adjustable relative to said elongated member.

16. The lighting system of claim 12, wherein said golf cup light assembly further comprises a battery charging port wired to turn off said LEDs when connected to an external power supply.

17. A method of lighting an area of a golf course, comprising:

activating a light source within a golf cup light assembly;

placing said golf cup light assembly into a golf cup hole located on a golf course;

inserting each of a plurality of riser-mounted lights into one of a plurality of base receptacles buried within the soil of said golf course;

activating said riser-mounted lights by supplying power from said base receptacles to said riser-mounted lights.

18. The method of claim 17, further comprising removing each of said plurality of riser-mounted lights from each of said plurality of base receptacles.

19. The method of claim 17, wherein said inserting each of said plurality of riser-mounted lights into one or a plurality of base receptacles further comprises coupling a first set of electrical connections on a bottom of each of said riser-mounted lights with a second set of electrical connections within each of said base receptacles.

20. The method of claim 17, wherein said supplying power from said base receptacles further comprises supplying power to each of said plurality of base receptacles from a power transformer.

* * * * *